US005752558A

United States Patent [19]

Lin

[11] Patent Number: 5,752,558

[45] Date of Patent: May 19, 1998

[54] TENSIONING DEVICE FOR A CONTROL CORD OF A BLIND ASSEMBLY

[76] Inventor: Cheng-Tai Lin, No. 33, Ching-Ho Tsun, Shui-Shang Hsiang, Chia-Yi Hsien, Taiwan

[21] Appl. No.: 876,760

[22] Filed: Jun. 16, 1997

[51] Int. Cl.[6] ..... A47H 5/00

[52] U.S. Cl. ..... 160/320; 160/178.1 V; 16/219

[58] Field of Search ..... 160/168.1 V, 173 V, 160/176.1 V, 178.1 V, 320, 341, 344, 345; 16/216, 217, 218, 219, DIG. 8

[56] References Cited

U.S. PATENT DOCUMENTS

| | | | |
|---|---|---|---|
| 4,335,776 | 6/1982 | Debs | 160/320 |
| 4,366,852 | 1/1983 | Holzer | 160/320 |
| 5,242,006 | 9/1993 | Ortega | 160/320 X |

*Primary Examiner*—David M. Purol

*Attorney, Agent, or Firm*—Townsend and Townsend and Crew LLP

[57] ABSTRACT

A tensioning device is to be used with a control cord of a blind assembly and includes a hollow casing which confines a vertically extending receiving space and which has an open top end portion and a bottom end provided with a pivot portion. A pivot unit mounts rotatably the pivot portion of the casing on a wall body. A cord engaging unit has a pulley formed with a cord engaging groove for passing over of the control cord, and a base slidably provided in the receiving space and having a front side formed with a pulley receiving recess. The pulley is mounted rotatably to the base in the pulley receiving recess. The base further has a top wall formed with a pair of notches which permit extension of parallel sections of the control cord that passes over the pulley. A cover member is mounted on the open top end portion of the casing, and is formed with a pair of slits that are aligned with the notches in the top wall of the base and that permit extension of the parallel sections of the control cord therethrough. A force generating member is provided in the receiving space and forces the base of the cord engaging unit downwardly in the casing in order to permit tensing of the control cord when the casing is mounted on the wall body.

8 Claims, 6 Drawing Sheets

TENSIONING DEVICE FOR A CONTROL CORD OF A BLIND ASSEMBLY

BACKGROUND OF THE INVENTION

1. Field of the Invention

The invention relates to an accessory for a blind assembly, more particularly to a tensioning device for a control cord of a blind assembly.

2. Description of the Related Art

A conventional blind assembly having vertically extending slats is generally provided with a tilting control cord that is operable so as to control the angle of the slats in order to vary the amount of light that can pass through the blind assembly, and a drawing control cord that is operable so as to draw together or draw apart the slats. Since the control cords are generally lightweight and flexible, a tensioning device is usually hung on a lower end portion of at least one of the control cords to prevent tangling of the same due to uncontrolled swinging of the control cords.

Referring to FIG. 1, a conventional tensioning device 1 for a control cord of a conventional blind assembly is shown to comprise a hollow casing 10 which confines a receiving space 12 for receiving a weight 11 therein, and which has an inner wall surface formed with a horizontal axle 13 adjacent to a top end portion of the casing 10. The axle 13 has a pulley 14 mounted rotatably thereon. A cover 15 is mounted on the top end portion of the casing 10 and is formed with a slot 16. The lower end portion of a control cord (not shown) extends into the casing 10 via the slot 16 and passes over the pulley 14, thereby hanging the tensioning device 1 on the lower end portion of the control cord. The weight 11 in the casing 10 pulls the control cord so as to maintain the latter in a tensed state to avoid tangling of the control cord.

It is noted that the weight 11 should not be too heavy so as not to strain the control cord. Thus, when blown by a strong gust of wind, the tensioning device 1 is liable to swing and strike a wall or an adjacent object repeatedly to create an annoying sound. In addition, since the tensioning device 1 is not fixed and is within the reach of children, a child playing with the control cord may be accidentally strangled by the same.

SUMMARY OF THE INVENTION

Therefore, the main object of the present invention is to provide a tensioning device for a control cord of a blind assembly, the tensioning device being adapted to be mounted rotatably on a wall body so as to prevent movement of the tensioning device toward and away from the wall body for improved safety and so as to avoid the generation of noise while permitting smooth operation of the control cord.

Another object of the present invention is to provide a tensioning device of the aforementioned type which is adapted for use with two control cords of a conventional blind assembly.

According to one aspect of the invention, a tensioning device is adapted for use with a control cord of a blind assembly and comprises:

a hollow casing which confines a vertically extending receiving space and which has an open top end portion and a bottom end provided with a pivot portion;

a pivot unit adapted for mounting rotatably the pivot portion of the hollow casing on a wall body;

a cord engaging unit including a pulley which has a periphery formed with an annular cord engaging groove that is adapted for passing over of the control cord, and a base which is slidably provided in the receiving space of the hollow casing and which has a front side formed with a pulley receiving recess, the pulley being mounted rotatably to the base in the pulley receiving recess, the base further having a top wall formed with a pair of notches which are adapted to permit extension of parallel sections of the control cord that passes over the pulley;

a cover member mounted on the open top end portion of the hollow casing and formed with a pair of slits that are aligned with the notches in the top wall of the base and that are adapted to permit extension of the parallel sections of the control cord therethrough; and a force generating member provided in the receiving space of the hollow casing and associated operably with the cord engaging unit so as to force the base downwardly in the hollow casing in order to permit tensing of the control cord when the hollow casing is mounted on the wall body.

According to another aspect of the invention, a tensioning device is adapted for use with two control cords of a blind assembly and comprises:

a hollow casing which confines a vertically extending space and which is provided with a partition wall that: divides the space into first and second receiving spaces, the hollow casing having an open top end portion and a bottom end provided with a pivot portion;

a pivot unit adapted for mounting rotatably the pivot portion of the hollow casing on a wall body;

two cord engaging units, each of which includes a pulley which has a periphery formed with an annular cord engaging groove that is adapted for passing over of a respective one of the control cords, and a base which is slidably provided in a respective one of the first and second receiving spaces of the hollow casing and which has a front side formed with a pulley receiving recess, the pulley being mounted rotatably to the base in the pulley receiving recess, the base further having a top wall formed with a pair of notches which are adapted to permit extension of parallel sections of the respective one of the control cords that passes over the pulley;

a cover member mounted on the open top end portion of the hollow casing and formed with two pairs of slits, the slits in each of the pairs being aligned with the notches in the base of a corresponding one of the cord engaging units and being adapted to permit extension of the parallel sections of a respective one of the control cords therethrough; and two force generating members, each of which is provided in a respective one of the first and second receiving spaces of the hollow casing and is associated operably with a respective one of the cord engaging units so as to force the base of the respective one of the cord engaging units downwardly in the hollow casing in order to permit tensing of a respective one of the control cords when the hollow casing is mounted on the wall body.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
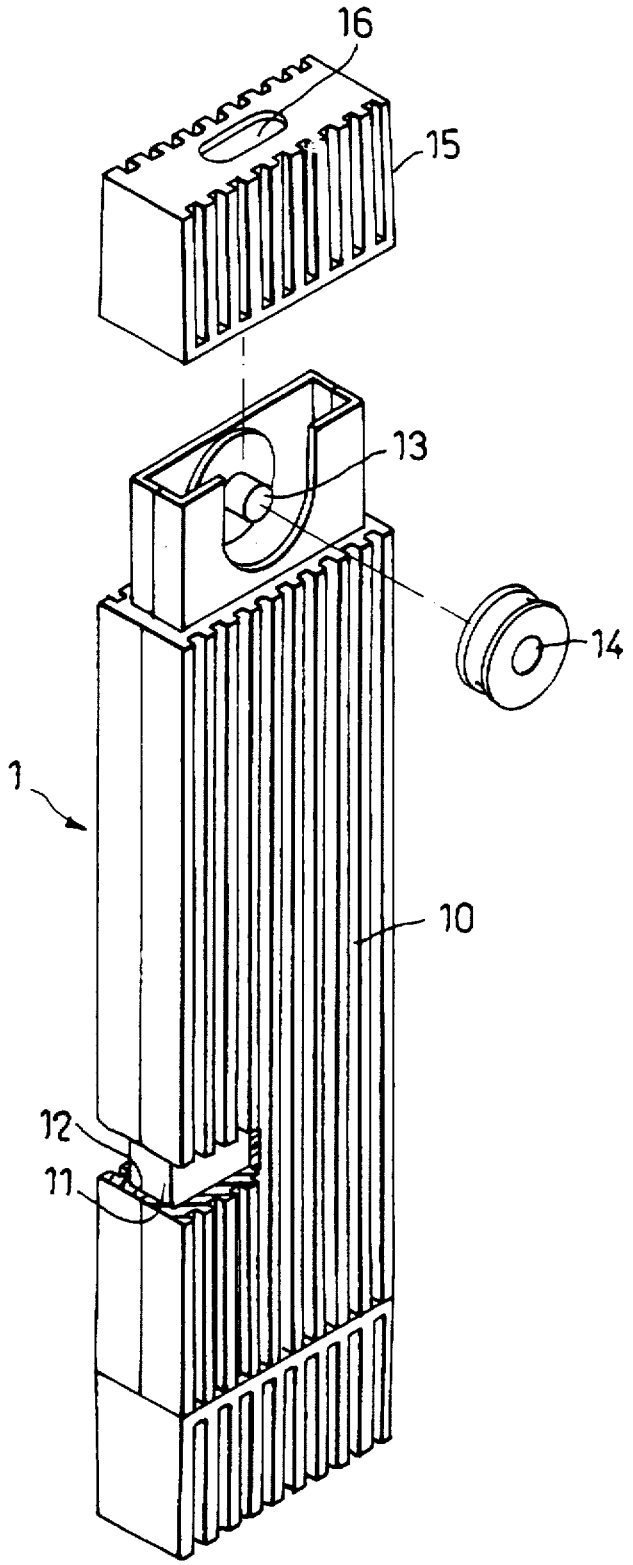
FIG.1 PRIOR ART
FIG. 1 is a partly exploded view of a conventional tensioning device for a control cord of a blind assembly.
Figure 2:
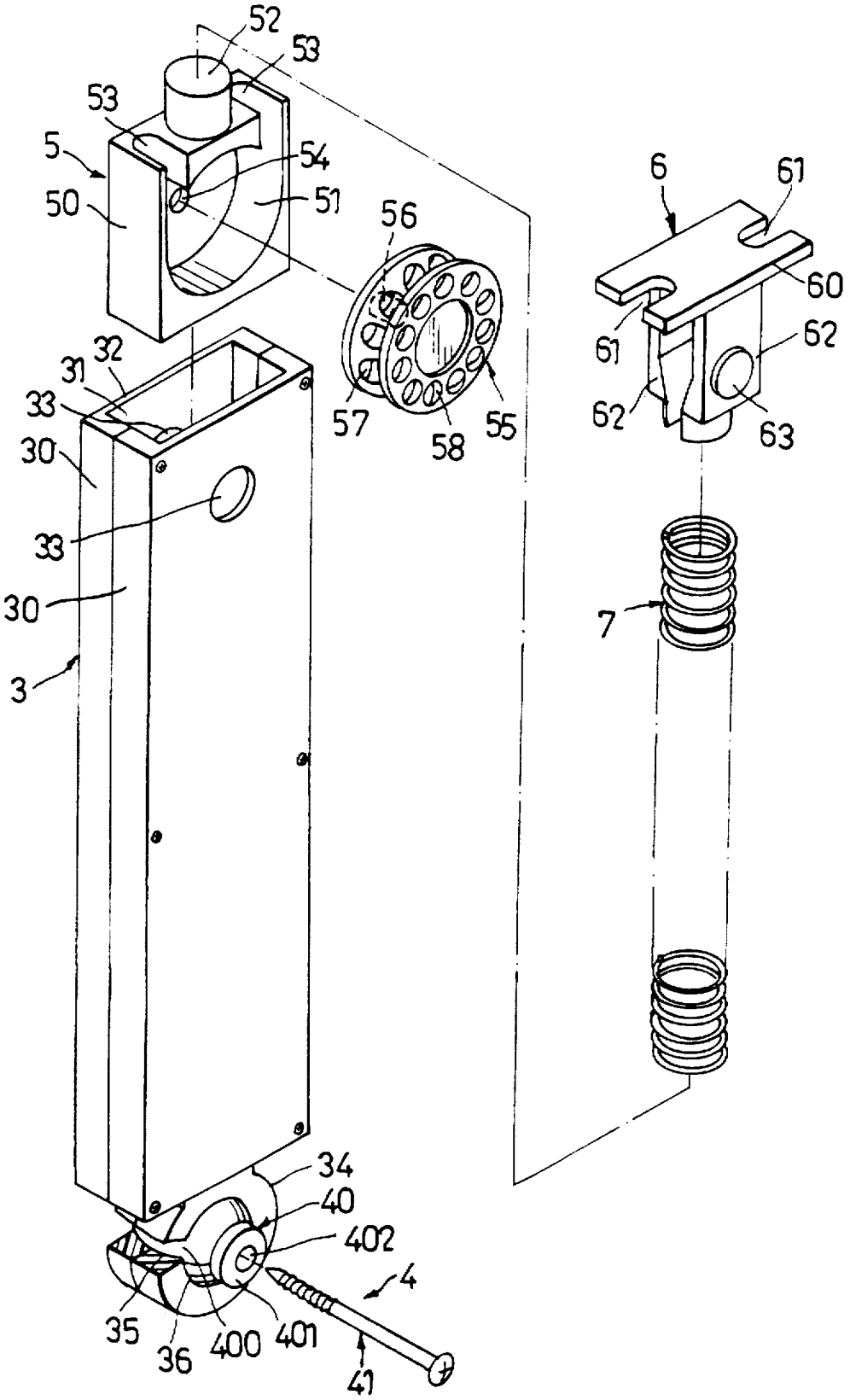
FIG. 2 is a partly exploded view of the first preferred embodiment of a tensioning device for a control cord of a conventional blind assembly in accordance with the present invention.
Figure 3:
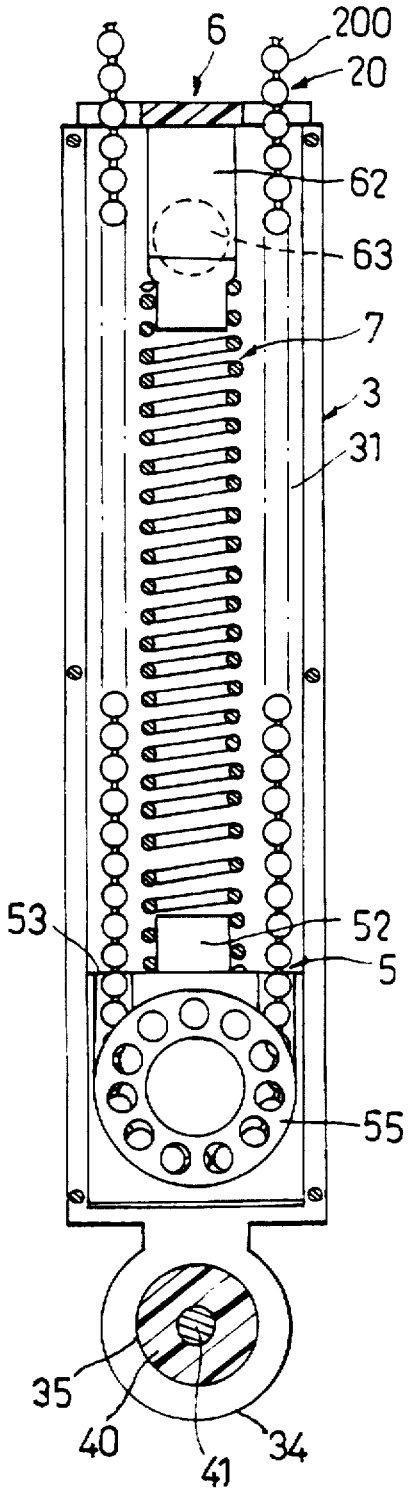
FIG. 3 is a schematic partly sectional view of the first preferred embodiment when used with a beaded control cord of a conventional blind assembly.

Referring to FIGS. 2 and 3, the first preferred embodiment of a tensioning device according to the present invention is shown to be adapted for use with a beaded control cord 20 of a conventional blind assembly. The tensioning device comprises a hollow casing 3, a pivot unit 4, a cord engaging unit 5, a cover member 6 and a force generating member 7.

The hollow casing 3 includes front and rear casing halves 30 which are mounted to each other by means of screws. The hollow casing 3 confines a vertically extending receiving space 31 and has an open top end portion 32 with opposed wall sections that are formed with a pair of aligned retaining holes 33. Each of the casing halves 30 has a bottom end formed with a pivot portion 34. The pivot portions 34 of the casing halves 30 cooperatively confine a spherical cavity 35 therebetween and are formed with aligned openings 36 that extend through the spherical cavity 35.

Figure 4:
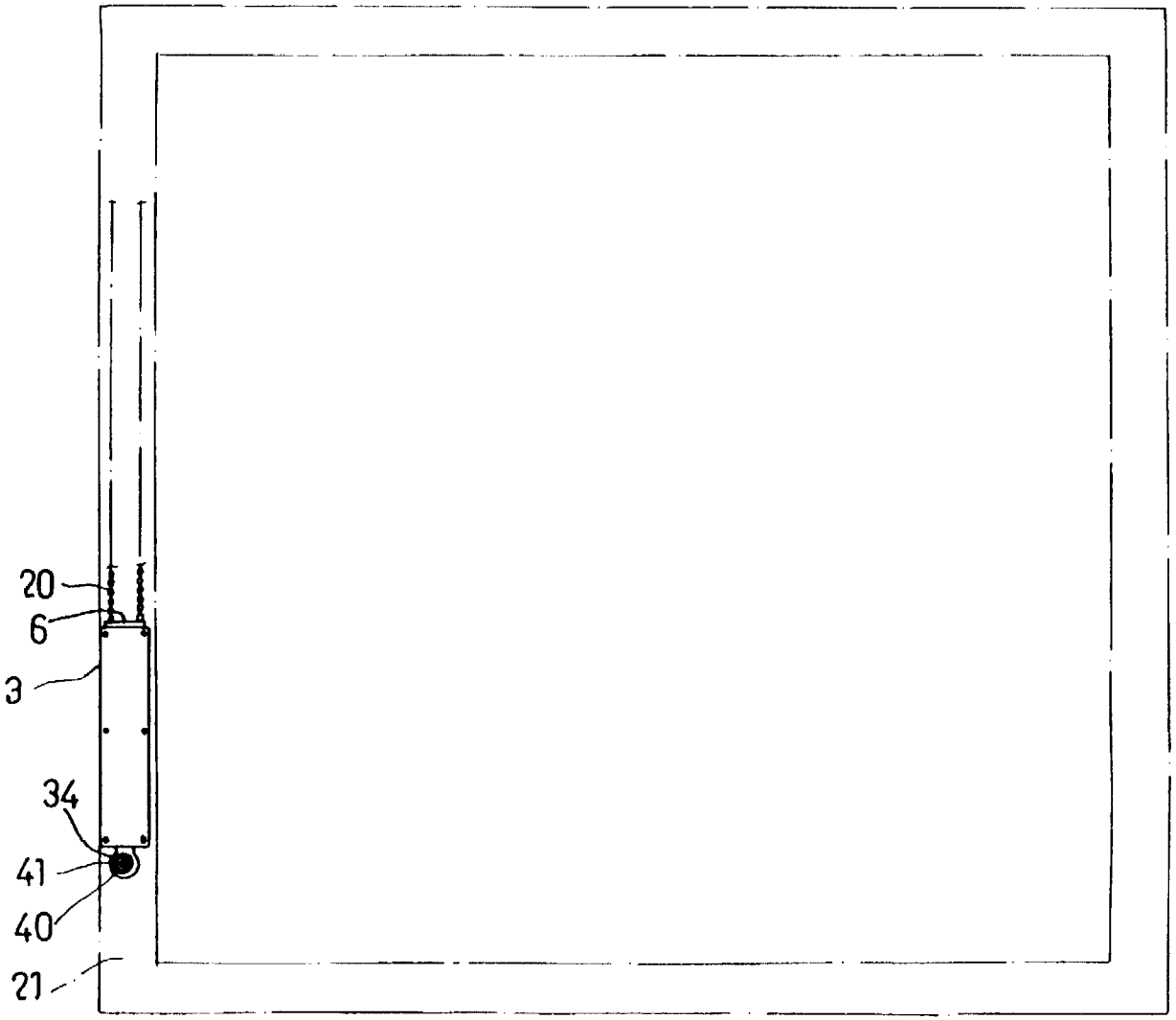
FIG. 4 is a schematic view illustrating the first preferred embodiment when in a state of use.

The pivot unit 4 includes a pivot block 40 and a fastener 41. The pivot block 40 is received in the spherical cavity 35 that is confined by the pivot portions 34 of the casing halves 30 and has a spherical surface 400 which abuts slidably against inner wall surfaces of the pivot portions 34 that confine the spherical cavity 35. The pivot block 40 is formed with a pair of diametrically opposite protrusions 401 that extend through the openings 36 in the pivot portions 34. The pivot block 40 is further formed with a fastener hole 402 which extends through the protrusions 401. The fastener 41, such as the screw fastener used in the present embodiment, extends through the fastener hole 402 to mount securely the pivot block 40 on a wall body 21, such as a window frame, as shown in FIG. 4. As such, the hollow casing 3 is rotatable relative to the pivot block 40 about the axis of the fastener 41.

The cord engaging unit 5 includes a rectangular base 50 and a pulley 55. The base 50 is slidably provided in the receiving space 31 of the hollow casing 3, and has a front side formed with a pulley receiving recess 51 which is circular in shape. The base 50 further has a top wall formed with an upwardly extending retaining projection 52, and a pair of notches 53 disposed on opposite sides of the projection 52 for communicating the receiving space 31 with the recess 51. The base 50 further has a rear wall formed with a central pivot hole 54. The pulley 55 is disposed in the pulley receiving recess 51 of the base 50, and has a rear side formed with an axial pivot shaft 56 that extends into the pivot hole 54 in the rear wall of the base 50, thereby mounting rotatably the pulley 55 to the base 50 in the recess 51. The pulley 55 has a periphery formed with an annular cord engaging groove 57, and is further formed with an annular series of axially extending bead engaging holes 58 to adapt the pulley 55 for use with the beaded control cord 20.

The cover member 6 is used to cover the open top end portion 32 of the hollow casing 3 and includes a cover plate 60 disposed on the open top end portion 32. The cover plate 60 is formed with a pair of slits 61 that are aligned with the notches 53 in the top wall of the base 50. The cover member 6 further includes a parallel pair of resilient spring arms 62 that are spaced apart from each other and that extend downwardly from the cover plate 60 and into the receiving space 31 of the hollow casing 3. Each of the spring arms 62 has one side formed with a retaining projection 63 for engaging a respective one of the retaining holes 33 in the hollow casing 3.

In this embodiment, the force generating member 7 is in the form of a coiled compression spring which is provided in the receiving space 31 of the hollow casing 3 between the cord engaging unit 5 and the cover member 6. The force generating member 7 has an upper end which abuts against the spring arms 62 of the cover member 6, and a lower end which engages the projection 52 on the top wall of the base 50 of the cord engaging unit 5.

During assembly, the pivot block 40 is received in the pivot portion 34 of the rear casing half 30 before the front and rear casing halves 30 are mounted to each other. Once the casing halves 30 are secured to one another with the use of screws, the hollow casing 3 is rotatable relative to the pivot block 40, and the protrusions 401 extend through the openings 36 in the pivot portions 34. Thereafter, the lower end portion 200 of the control cord 20 is passed over the pulley 55 in the cord engaging groove 57 of the latter, and parallel sections of the lower end portion 200 of the control cord 20 are extended through the notches 53 in the top wall of the base 50. The lower end of the force generating member 7 is engaged with the projection 52 on the top wall of the base 50, and the base 50 is slidably provided in the receiving space 31 of the hollow casing 3. The spring arms 62 of the cover member 6 are subsequently extended into the open top end portion 32 of the hollow casing 3 so as to abut against the upper end of the force generating member 7. The slits 61 in the cover plate 60 are aligned with the notches 53 in the top wall of the base 50 to permit extension of the parallel sections of the lower end portion 200 of the control cord 20 therethrough. The retaining projections 63 on the spring arms 62 engage the retaining holes 33 in the hollow casing 3 to secure the cover member 6 on the hollow casing 3.

Referring to FIGS. 3 and 4, the fastener 41 extends through the fastener hole 402 and mounts securely the pivot block 40 on a wall body 21 such that the control cord 20 is in a tensed state to avoid tangling of the latter. In this embodiment, the wall body 21 is a window frame, and the mounting location of the fastener 41 on the wall body 21 is selected such that the force generating member 7 is slightly compressed, i.e. the bottom wall of the base 50 forms a clearance with the bottom wall of the hollow casing 3. Thus, the force generating member 7 pushes the base 50 downwardly in the hollow casing 3 to enable the latter to pull the lower end portion 200 of the control cord 20 and maintain the control cord 20 in the tensed state.

When the control cord 20 is operated, the pulley 55 is rotatable within the base 50 to ensure smooth movement of the control cord 20. In addition, since the pivot unit 4 mounts rotatably the hollow casing 3 on the wall body 21, the hollow casing 3 can rotate accordingly about the axis of the fastener 41 to ensure smooth operation of the control cord 20.

Since the tensioning device of this invention can be mounted securely on a wall body, the tensioning device is not likely to swing and strike the wall body or an adjacent object repeatedly to avoid the creation of an annoying sound even in the presence of a strong gust of wind. Moreover, the tensioning device can be fixed so as not to be easily reached by children to minimize the risk of a child being accidentally strangled by the control cord 20.

Figure 5:
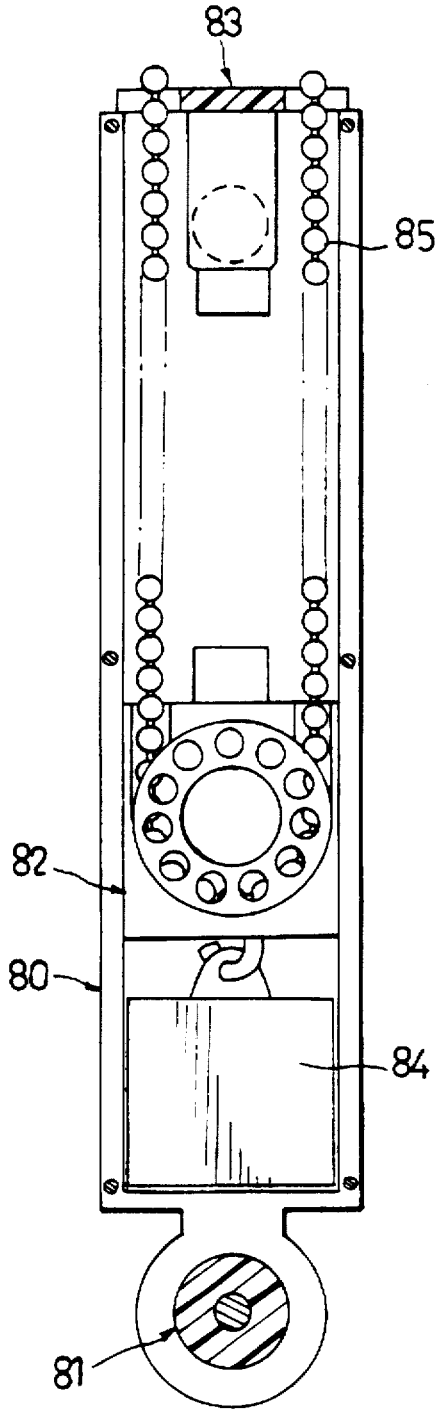
FIG. 5 is a schematic partly sectional view of the second preferred embodiment of a tensioning device according to the present invention when used with a beaded control cord of a conventional blind assembly.

FIG. 5 illustrates the second preferred embodiment of a tensioning device for a beaded control cord 85 of a conventional blind assembly in accordance with the present invention. Like the previous embodiment, the tensioning device comprises a hollow casing 80, a pivot unit 81, a cord engaging unit 82, a cover member 83 and a force generating member 84. However, in this embodiment, the force generating member 84 is in the form of a weight which is mounted to a bottom wall of a base of the cord engaging unit 82. When the tensioning device of this embodiment is mounted on a wall body, the force generating member 84 pulls the cord engaging unit 82 downwardly in the hollow casing 80 to enable the latter to pull the control cord 85 and maintain the same in a tensed state.

Figure 6:
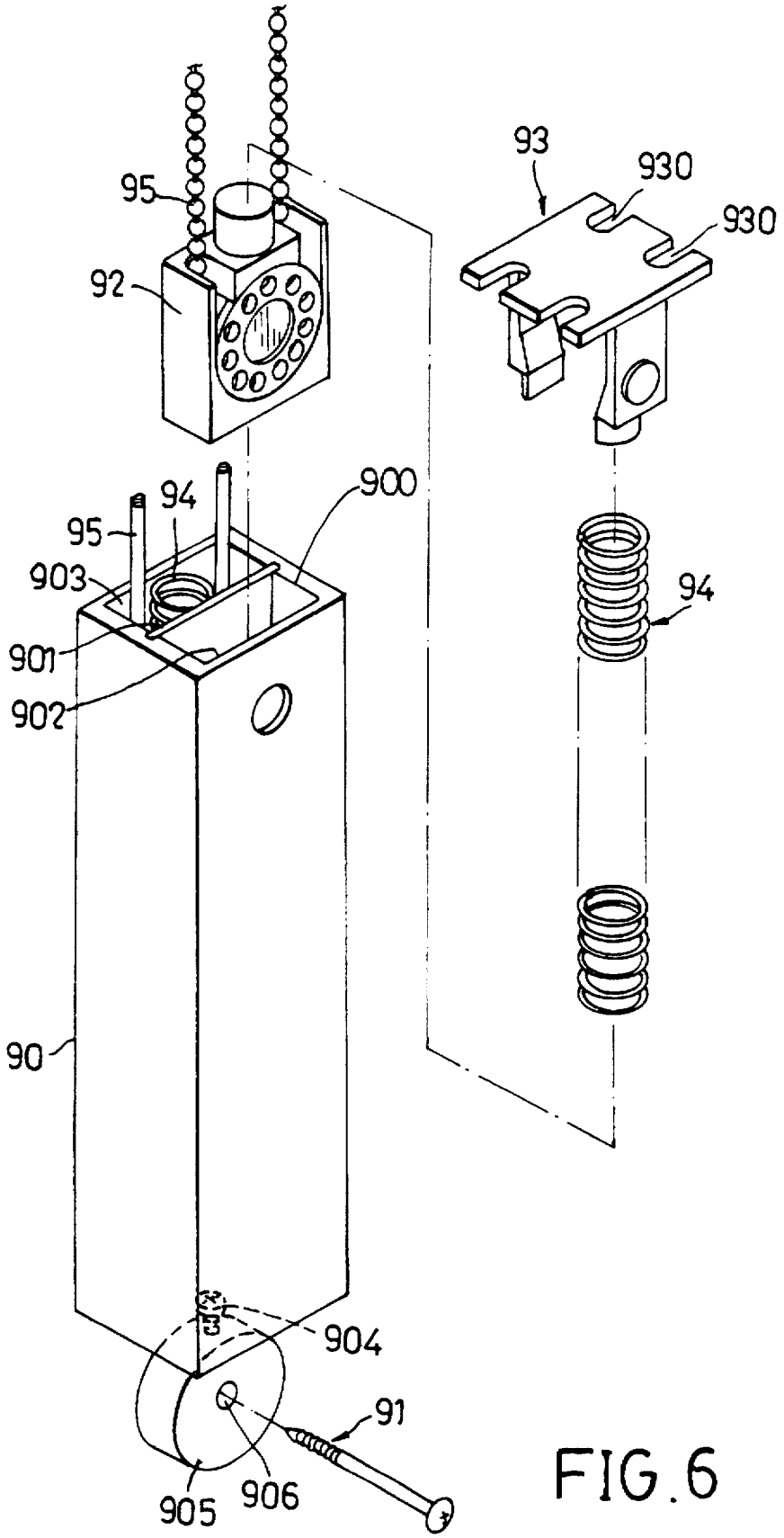
FIG. 6 is a partly exploded view of the third preferred embodiment of a tensioning device that is adapted for use with two control cords of a conventional blind assembly in accordance with the present invention.

FIG. 6 illustrates the third preferred embodiment of a tensioning device according to the present invention which is adapted for use with two control cords 95 of a conventional blind assembly. The tensioning device comprises a hollow casing 90, a pivot unit 91, two cord engaging units 92 (only one is shown), a cover member 93 and two force generating members 94. In this embodiment, the hollow casing 90 is a one-piece casing body which confines a vertically extending space 900 and which is provided with a partition wall 901 that divides the space 900 into first and second receiving spaces 902, 903. Each of the receiving spaces 902, 903 has one of the cord engaging members 92 and one of the force generating members 94 provided therein. The cord engaging members 92 and the force generating members 94 are similar to those of the first preferred embodiment and will not be described further. The hollow casing 90 has a bottom end with a pivot portion 905 mounted thereon with the use of a screw 904. The pivot portion 905 is formed with an opening 906. The pivot unit 91 is in the form of a fastener 91, such as a screw, which extends through the opening 906 to mount rotatably the hollow casing 90 on a wall body (not shown). Unlike the cover member 6 of the first preferred embodiment, the cover member 93 is formed with two pairs of slits 930, the slits 930 in each of the pairs permitting the extension of the parallel sections of a corresponding one of the control cords 95 therethrough. The operation of the third preferred embodiment is generally similar to that of the previous embodiments and will not be detailed further.

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

I claim:

1. A tensioning device adapted for use with a control cord of a blind assembly, said tensioning device comprising:

a hollow casing which confines a vertically extending receiving space and which has an open top end portion and a bottom end provided with a pivot portion;

a pivot unit adapted for mounting rotatably said pivot portion of said hollow casing on a wall body;

a cord engaging unit including a pulley which has a periphery formed with an annular cord engaging groove that is adapted for passing over of the control cord, and a base which is slidably provided in said receiving space of said hollow casing and which has a front side formed with a pulley receiving recess, said pulley being mounted rotatably to said base in said pulley receiving recess, said base further having a top wall formed with a pair of notches which are adapted to permit extension of parallel sections of the control cord that passes over said pulley;

a cover member mounted on said open top end portion of said hollow casing and formed with a pair of slits that are aligned with said notches in said top wall of said base and that are adapted to permit extension of the parallel sections of the control cord therethrough; and a force generating member provided in said receiving space of said hollow casing and associated operably with said cord engaging unit so as to force said base downwardly in said hollow casing in order to permit tensing of the control cord when said hollow casing is mounted on the wall body.

2. The tensioning device of claim 1, wherein said pivot portion of said hollow casing confines a spherical cavity and is formed with an opening through said spherical cavity, said pivot unit including a pivot block which has a spherical surface and which is slidably confined in said spherical cavity, said pivot block being formed with a fastener hole that is aligned with said opening in said pivot portion, said hollow casing being rotatable relative to said pivot block about axis of said fastener hole, said pivot unit further including a fastener which extends through said opening and said fastener hole and which is adapted to mount securely said pivot block on the wall body.

3. The tensioning device of claim 1, wherein said open top end portion of said hollow casing has opposed wall sections that are formed with a pair of retaining holes, said cover member including a cover plate disposed on said open top end portion of said hollow casing, and a parallel pair of resilient spring arms that are spaced apart from each other and that extend downwardly from said cover plate and into said receiving space of said hollow casing, each of said spring arms having one side formed with a retaining projection for engaging a respective one of said retaining holes in said hollow casing.

4. The tensioning device of claim 1, wherein said force generating member includes a coiled compression spring which has opposite ends that abut respectively against said base of said cord engaging unit and said cover member, said force generating member pushing said base downwardly in said hollow casing.

5. The tensioning device of claim 1, wherein said force generating member includes a weight which is mounted to said base.

6. A tensioning device adapted for use with two control cords of a blind assembly, said tensioning device comprising:

a hollow casing which confines a vertically extending space and which is provided with a partition wall that divides said space into first and second receiving spaces, said hollow casing having an open top end portion and a bottom end provided with a pivot portion;

a pivot unit adapted for mounting rotatably said pivot portion of said hollow casing on a wall body;

two cord engaging units, each of which includes a pulley which has a periphery formed with an annular cord engaging groove that is adapted for passing over of a respective one of the control cords, and a base which is slidably provided in a respective one of said first and second receiving spaces of said hollow casing and which has a front side formed with a pulley receiving recess, said pulley being mounted rotatably to said base in said pulley receiving recess, said base further having a top wall formed with a pair of notches which are adapted to permit extension of parallel sections of the respective one of the control cords that passes over said pulley;

a cover member mounted on said open top end portion of said hollow casing and formed with two pairs of slits, said slits in each of said pairs being aligned with said notches in said base of a corresponding one of said cord engaging units and being adapted to permit extension of the parallel sections of a respective one of the control cords therethrough; and two force generating members, each of which is provided in a respective one of said first and second receiving spaces of said hollow casing and is associated operably with a respective one of said cord engaging units so as to force said base of the respective one of said cord engaging units downwardly in said hollow casing in order to permit tensing of a respective one of the control cords when said hollow casing is mounted on the wall body.

7. The tensioning device of claim 6, wherein said open top end portion of said hollow casing has opposed wall sections that are formed with a pair of retaining holes, said cover member including a cover plate disposed on said open top end portion of said hollow casing, and a parallel pair of resilient spring arms that are spaced apart from each other and that extend downwardly from said cover plate and into said vertically extending space of said hollow casing, each of said spring arms having one side formed with a retaining projection for engaging a respective one of said retaining holes in said hollow casing.

8. The tensioning device of claim 6, wherein each of said force generating members includes a coiled compression spring which has opposite ends that abut respectively against said base of the respective one of said cord engaging units and said cover member, each of said force generating members pushing said base of the respective one of said cord engaging units downwardly in said hollow casing.

* * * * *